US007389078B2

(12) United States Patent
Daishi et al.

(10) Patent No.: US 7,389,078 B2
(45) Date of Patent: Jun. 17, 2008

(54) FIXING METHOD, FIXING APPARATUS USING THE SAME, AND IMAGE FORMING APPARATUS

(75) Inventors: Fumio Daishi, Minamiashigara (JP); Noboru Endo, Minamiashigara (JP); Yasuo Sakaguchi, Minamiashigara (JP)

(73) Assignee: Fuji Zerox Co., Ltd., Tokyo (JP)

( * ) Notice: Subject to any disclaimer, the term of this patent is extended or adjusted under 35 U.S.C. 154(b) by 166 days.

(21) Appl. No.: 11/398,571

(22) Filed: Apr. 6, 2006

(65) Prior Publication Data

US 2007/0065192 A1 Mar. 22, 2007

(30) Foreign Application Priority Data

Sep. 20, 2005 (JP) ..... 2005-272935

(51) Int. Cl.
*G03G 15/20* (2006.01)

(52) U.S. Cl. ..... 399/329; 399/333; 430/124.3

(58) Field of Classification Search ..... 399/329, 399/333, 320, 328, 307; 219/216; 430/124.1, 430/124.3, 124.33
See application file for complete search history.

(56) References Cited

U.S. PATENT DOCUMENTS 5,051,784 A * 9/1991 Yamamoto et al. ..... 399/329
5,907,348 A * 5/1999 Ogasawara et al. ..... 399/329 X
6,377,777 B1 * 4/2002 Kishino et al. ..... 399/329
2004/0091296 A1 * 5/2004 Ishizuka et al. ..... 399/329

FOREIGN PATENT DOCUMENTS

JP 07-013448 A * 1/1995
JP B2 2784141 5/1998
JP B2 2903972 3/1999
JP 2000-338797 A * 12/2000
JP B2 3562578 6/2004
JP A 2004-331903 11/2004

* cited by examiner

*Primary Examiner*—Sophia S Chen
(74) *Attorney, Agent, or Firm*—Oliff & Berridge, PLC

(57) ABSTRACT

The invention provides a fixing method including conveying a recording medium on which a toner image has been formed using a fixing belt, in a state in which the fixing belt contacts with a surface of the recording medium on which the toner image is formed, at least from a fixing portion in which the toner image is fixed by heating and pressing the recording medium to a cooling portion in which the recording medium after fixing is cooled, wherein the ten-point average roughness (Rz) of a surface of the fixing belt contacting with the recording medium is 0.7 μm or less or the filtered maximum waviness in every convex portion present on a surface of the fixing belt contacting with the recording medium is 50 μm or less. The invention also provides a fixing apparatus using the method and an image forming apparatus using the method.

11 Claims, 4 Drawing Sheets

FIXING METHOD, FIXING APPARATUS USING THE SAME, AND IMAGE FORMING APPARATUS

CROSS-REFERENCE TO RELATED APPLICATION

This application claims priority under 35 USC 119 from Japanese Patent Application No. 2005-272935, the disclosure of which is incorporated by reference herein.

BACKGROUND

1. Technical Field

The present invention relates to a method of fixing a toner image onto a recording medium such as paper when forming an image by using electrophotography, a fixing apparatus using the same, and an image forming apparatus using the same.

2. Related Art

Use of a fixing apparatus having a fixing belt stretched between a heat roller and a release roller has been proposed in an image-forming apparatus for forming a glossy image, such as a copying machine. In the fixing apparatus, paper onto which a toner image has been transferred is heated and pressed in a state where the surface on which the toner image is formed is contacted with the fixing belt, and the paper is conveyed on the fixing belt and simultaneously cooled, and separated from the fixing belt at the position of a release roller, whereby a glossy image is formed on the paper.

Heat-resistant fluorine resin, fluorine rubber, fluorine-based elastomer or silicone rubber is used as a surface material forming the outer periphery of the fixing belt utilized in the fixing apparatus.

A substrate of the fixing belt may be made of a metal such as stainless steel, nickel steel or the like, however, a fixing belt thus constituted has the problem that an operator can be hurt by the edge of the fixing belt upon generation of jams or during production, thus making handling inconvenient. In addition, the heat capacity of the fixing belt as a whole is high, so there is a problem of increasing the electric power consumed.

To solve these problems, a heat-resistant resin belt having a substrate of heat-resistant resin and a surface layer of a heat-resistant elastic body arranged on the outer periphery of the substrate has been proposed.

SUMMARY

However, there is a problem with the fixing system of cooling a recording medium and simultaneously conveying it in contact with the surface of a fixing belt after fixing, in that image defects such as deficient mirror surface properties and white-spot defects on the image surface can occur depending on the fixing belt used.

The invention was made in view of the circumstances described above. That is, the invention provides a fixing method capable of suppressing generation of image defects, as well as a fixing apparatus and an image-forming apparatus using the same.

The inventors extensively examined the reason for generation of image defects such as deficient mirror surface properties and white-spot defects on the surface of an image in the fixing method wherein a recording medium is conveyed while keeping contact with the fixing belt after fixing.

In this fixing system, a toner image that is in a molten and softened state due to heating and pressing during fixing is kept in contact with the surface of the fixing belt until it is solidified by cooling. Accordingly, it is thought that the surface state of the solidified toner image (that is, the resulting image) strongly reflects the surface state of the fixing belt, as compared with a fixing system which does not include conveying a recording medium after fixing in a state where the recording medium contacts with the fixing belt. That is, it is believed that generation of defects such as poor mirror surface properties and white-spot defects of the image surface depend significantly on the surface state of the fixing belt.

Accordingly, the inventors further extensively studied the relationship between the fixing belt used in forming an image and image defects such as poor mirror surface properties and white-spot defects of the image surface.

When the surface of the fixing belt was observed with the naked eye, it was found that as the tendency for the shape of an image reflecting a light source positioned at a distance of several meters to be indefinite (the "orange peel" effect) is increased, poor mirror surface properties tend to be more significant. It was thus estimated that the mirror surface properties of the image surface are governed by short-cycle unevenness of the surface of the fixing belt.

It was also found that white-spot defects tend to be observed when relatively large convex portions (long-cycle unevenness) of the surface of the fixing belt are present. Accordingly, it was estimated that toners formed on a recording medium upon fixing are removed by the relatively large convex portions present on the surface of the fixing belt.

On the basis of the findings described above, the inventors discovered the following invention.

A first aspect of the invention provides a fixing method comprising conveying a recording medium on which a toner image has been formed using a fixing belt, in a state in which the fixing belt contacts with a surface of the recording medium on which the toner image is formed, at least from a fixing portion in which the toner image is fixed by heating and pressing the recording medium to a cooling portion in which the recording medium is cooled after fixing, wherein a ten-point average roughness (Rz) of a surface of the fixing belt contacting with the recording medium is 0.7 μm or less.

A second aspect of the invention provides a fixing method comprising conveying a recording medium on which a toner image has been formed using a fixing belt, in a state in which the fixing belt contacts with a surface of the recording medium on which the toner image is formed, at least from a fixing portion in which the toner image is fixed by heating and pressing the recording medium to a cooling portion in which the recording medium is cooled after fixing, wherein a filtered maximum waviness in every convex portion present on a surface of the fixing belt contacting with the recording medium is 50 μm or less.

A third aspect of the invention provides a fixing apparatus comprising a fixing belt, a pair of fixing members having the fixing belt sandwiched therebetween and pressed against each other so as to form a fixing portion that heats and presses a recording medium having a toner image formed thereon, at least one of which has a heating function, and a cooling portion that cools the recording medium after the recording medium has passed through the fixing portion, during which the recording medium is conveyed in a state in which the recording medium is retained on the surface of the fixing belt, wherein a ten-point average roughness (Rz) of a surface of the fixing belt contacting with the recording medium is 0.7 μm or less.

A fourth aspect of the invention provides a fixing apparatus comprising a fixing belt that conveys a recording medium on which a toner image has been formed, in a state in which the fixing belt contacts with a surface of the recording medium on which the toner image is formed, at least from a fixing portion in which the toner image is fixed by heating and pressing the recording medium to a cooling portion in which the recording medium is cooled after fixing, wherein a filtered maximum waviness in every convex portion present on a surface of the fixing belt contacting with the recording medium is 50 μm or less.

A fifth aspect of the invention provides an image forming apparatus comprising at least an image holding member, a charging apparatus that charges a surface of the image holding member, a latent image forming apparatus that forms a latent image on the charged surface of the image holding member, a developing apparatus that develops the latent image with a developer to form a toner image, a transfer apparatus that transfers the toner image to a transfer material, and a fixing apparatus that thermally fixes the toner image on a recording medium, wherein the fixing apparatus comprises a fixing belt, a pair of fixing members having the fixing belt sandwiched therebetween and pressed against each other so as to form a fixing portion that heats and presses a recording medium having a toner image formed thereon, at least one of which has a heating function, and a cooling portion that cools the recording medium after the recording medium has passed through the fixing portion, during which the recording medium is conveyed in a state in which the recording medium is retained on the surface of the fixing belt, wherein a ten-point average roughness (Rz) of a surface of the fixing belt contacting with the recording medium is 0.7 μm or less.

A sixth aspect of the invention provides an image forming apparatus comprising at least an image holding member, a charging apparatus that charges a surface of the image holding member, a latent image forming apparatus that forms a latent image on the charged surface of the image holding member, a developing apparatus that develops the latent image with a developer to form a toner image, a transfer apparatus that transfers the toner image to a transfer material, and a fixing apparatus that thermally fixes the toner image on a recording medium, wherein the fixing apparatus comprises a fixing belt that conveys a recording medium on which a toner image has been formed, in a state in which the fixing belt contacts with a surface of the recording medium on which the toner image is formed, at least from a fixing portion in which the toner image is fixed by heating and pressing the recording medium to a cooling portion in which the recording medium is cooled after fixing, wherein a filtered maximum waviness in every convex portion present on a surface of the fixing belt contacting with the recording medium is 50 μm or less.

DETAILED DESCRIPTION

<Fixing Method>

(First Fixing Method)

Figure 1:
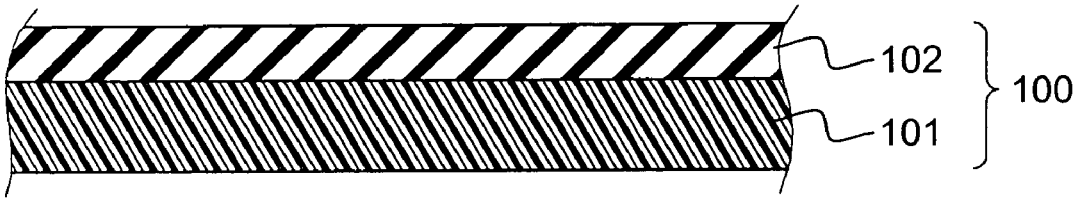
FIG. 1 is a schematic sectional view showing an example of the structure of the fixing belt of the invention.

The first fixing method of the invention is a fixing method using a fixing belt conveying a recording medium on which a toner image has been formed, in a state where the fixing belt contacts with the surface on which the toner image is formed, at least from a fixing portion in which the toner image is fixed by heating and pressing the recording medium to a cooling portion in which the recording medium is cooled after fixing, wherein the ten-point average roughness (Rz) of the surface of the fixing belt contacting with the recording medium is 0.7 μm or less.

Accordingly, the first fixing method of the invention can be utilized to form an image excellent in mirror surface properties.

For improving the mirror surface properties of an image, the ten-point average roughness (Rz) of the fixing belt contacting with the recording medium is preferably 0.5 μm or less. From practical viewpoints such as easiness in production of the fixing belt, the ten-point average roughness (Rz) is preferably 0.1 μm or more. When the ten-point average roughness (Rz) is greater than 0.7 μm, the surface of the fixing belt is in state of orange peel in outward appearance, and the mirror surface properties of the resulting image are deteriorated.

The ten-point average roughness (Rz) can be measured according to the definition of JIS B0601, the disclosure of which is incorporated by reference herein, under the measurement conditions of a cutoff value of 0.25 mm and measurement length of 1.25 mm by using SURFCOM 1400A-3GF (trade name) manufactured by TOKYO SEIMITSU Co., Ltd. When the surface of a measurement sample is soft and tacky, the sample can be measured after coating with a lubricating oil which does not cause a surface layer material to swell. When the surface of silicone rubber is measured, paraffin oil or fatty acid is preferably selected, and when fluorocarbon siloxane rubber is measured, the rubber is measured preferably after coating with silicone oil.

The layer structure of the fixing belt used in the first fixing method of the invention is not particularly limited, but preferably the fixing belt includes a heat-resistant elastic body having a surface contacting with a recording medium, and a substrate disposed at a side opposite to the surface of the heat-resistant elastic body contacting with the recording medium.

In the fixing belt having such layer structure, the heat-resistant elastic body can be formed at the outer periphery of the substrate for example by forming a coating by applying a resin solution onto the outer periphery of the substrate, which is fixed to the outer periphery of a cylindrical core, and thermally treating the coating at least once. This thermal treatment means every step in which a coating that has been formed is heated at ordinary temperature or higher, and examples thereof include drying treatment by heating, baking treatment for accelerating crosslinking and curing of the coating, etc. The number of times these thermal treatments are conducted, the type and combination of the thermal treatments, can be suitably selected depending on a material used in formation of the heat-resistant elastic body; for example, carrying out drying treatment, followed by curing treatment, or carrying out primary curing and secondary curing without drying treatment.

To regulate the ten-point average roughness (Rz) of the surface of the fixing belt (that is, the surface of the heat-resistant elastic body) so as to be 0.7 μm or less, the initial thermal treatment is conducted preferably by rotating the cylindrical core in a peripheral direction. In the initial thermal treatment after formation of the coating, the coating is fluidic so that when the cylindrical core is thermally treated by rotation in the peripheral direction, the ten-point average roughness (Rz) can be easily regulated to be 0.7 μm or less.

(Second Fixing Method)

The second fixing method of the invention is a fixing method using a fixing belt conveying a recording medium on which a toner image has been formed, in a state where the fixing belt contacts with the surface on which the toner image is formed, at least from a fixing portion in which the toner image is fixed by heating and pressing the recording medium to a cooling portion in which the recording medium is cooled after fixing, wherein a filtered maximum waviness in every convex portion present on the surface of the fixing belt contacting with the recording medium is 50 μm or less.

Accordingly, the second fixing method of the invention can be utilized to suppress generation of white-spot defects on the surface of an image.

For further reducing white-spot defects on the surface of an image, the filtered maximum waviness in every convex portion present on the surface of the fixing belt contacting with the recording medium is preferably 20 μm or less, and from practical viewpoints such as easiness of production of the fixing belt, the filtered maximum waviness is preferably 1.0 μm or more.

When the filtered maximum waviness in at least one of all convex portions present on the surface of the fixing belt contacting with the recording medium is greater than 50 μm, there can occur a white-spot defect corresponding to that part. The white-spot defects are phenomenon in which the surface of the recording medium is exposed in an image-forming region by removal of toners as described above, and thus the white-spot defects do not necessarily mean white dotted defects, and when the surface color of a recording medium used is a color other than white that is the color of general paper, the white-spot defects are recognized as defects of that color.

The convex portion can be easily recognized as convex when the surface of the fixing belt contacting with a recording medium is observed with the naked eye under a fluorescent lamp. Regarding the filtered maximum waviness in every convex portion, whether the maximum value of the filtered maximum waviness of every convex portion is a predetermined value (50 μm) or less is judged by measuring all portions recognized visually as convex on the surface of the fixing belt contacting with a recording medium.

In the invention, the filtered maximum waviness can be measured under the conditions defined in JIS B0610, that is, a cutoff value of 2.5 mm and a measurement length of 5 mm, by using SURFCOM 1400A-3GF manufactured by TOKYO SEIMITSU Co., Ltd. Before measurement, a lubricating oil can be applied in the same manner as in measurement of roughness.

The layer structure of the fixing belt used in the second fixing method of the invention is not particularly limited, however, preferably the fixing belt includes at least a substrate, more preferably the fixing belt includes a heat-resistant elastic body having a surface contacting with a recording medium, and a substrate disposed at a side opposite to the surface of the heat-resistant elastic body contacting with the recording medium, similar to the fixing belt used in the first fixing method of the invention. This heat-resistant elastic body can be formed on the surface of the substrate by at least forming a coating as described above.

When the substrate in the fixing belt having such layer structure is produced by using a form such as a cylindrical core, minute foreign matter when occurring between the form and the substrate generates a convex portion in that portion, so even if a surface layer is disposed on the surface of the substrate, the surface layer reflects the convex portion. When this substrate is used to produce a fixing belt, the convex portion may cause a convex portion to be formed on the surface of the fixing belt contacting with a recording medium, to generate a white-spot defect.

In such case, the convex portion present on the surface of the substrate at the side of the fixing belt contacting with a recording medium is preferably flattened by hot pressing at 150° C. or higher and/or abrasion treatment.

—Structure of the Fixing Belt—

Now, the fixing belt used in the invention is described in more detail by reference to the layer structure and material and physical properties thereof in a specific example where the fixing belt includes a substrate and a heat-resistant elastic body (surface layer) disposed at one side of the substrate.

FIG. 1 is a schematic sectional view showing one example of the layer structure of the fixing belt used in the invention, wherein the fixing belt includes a substrate and a heat-resistant elastic body (surface layer) disposed at one side of the substrate. Generally speaking, the fixing belt used in the invention is preferably an endless belt, but is not limited to an endless belt (for an easier description, the fixing belt is described as an endless belt in this specification).

In FIG. 1, reference numeral 100 denotes a fixing belt, 101 denotes a substrate, 102 denotes a surface layer (heat-resistant elastic body), and in FIG. 1, the surface layer 102 is arranged in contact with the outer periphery of the substrate 101.

—Substrate—

The substrate of the fixing belt requires heat resistance and mechanical strength. Preferably, the heat resistance prevents practically problematic deteriorations such as deformation and reduction in mechanical strength from occurring in the range of preferably at a temperature of 80° C. or higher, more preferably 100° C. or more. Examples of the material meeting such heat resistance and mechanical strength include polyimide, polyamide imide, polybenzimidazole etc., and these heat-resistant resins are preferably used to form the substrate.

The method of forming the substrate is not particularly limited, may be a method known in the art, but is preferably a method wherein the substrate is formed with the outer periphery thereof being contacted with a solid member such as a mold, and specifically centrifugal forming is preferably used.

The substrate may contain an organic or inorganic filler for the purpose of improving mechanical strength, and the filler may be selected from various fillers used in general silicone rubber compositions and polyimide compositions. Specific examples of the fillers include reinforcing fillers such as aerosol silica, precipitated silica, carbon black, carbon powder, titanium dioxide, aluminum oxide, quartz powder, talc, sericite and bentonite and fibrous fillers such as asbestos, glass fiber and organic fiber.

The thickness of the substrate is preferably in the range of 20 to 200 μm, more preferably 30 to 150 μm, and still more preferably 40 to 130 μm. When the thickness of the substrate is less than 20 μm, the substrate may be poor in dimensional stability during heating or cooling or in strength. On the other hand, when the thickness is greater than 200 μm, the heat capacity of the fixing belt as a whole is increased to reduce the amount of heat transferred, and thus when the substrate is used in a fixing apparatus or an image-forming apparatus, the rate of transfer or cycle time may be reduced and simultaneously the electric power consumed may be increased.

The surface layer is preferably composed of an elastic body. This elastic body desirably has a JIS type A rubber hardness of A80/S or less (the method thereof is defined as a type A durometer hardness which is described in JIS K6253 (1997), the disclosure of which is incorporated by reference herein) and a water contact angle of 90° or more.

Preferable examples of the elastic body meeting such physical properties include, but are not limited to, fluorine-based elastomers such as silicone rubber, fluorine rubber and fluorocarbon siloxane rubber.

When a convex portion is present on the surface of the substrate used in the second fixing method, (1) hot pressing or (2) abrasion treatment is preferably conducted as described above.

(1) Hot Pressing

From the viewpoint of reducing the height of the convex portion easily and sufficiently, hot pressing is carried out preferably at 150° C. or more, more preferably 180° C. or more. The pressure is preferably not lower than 1 N/cm$^2$, more preferably not lower than 5 N/cm$^2$. As the temperature is increased, the pressure can be reduced, however, it is particularly preferable that hot pressing is carried out basically at a temperature of 150° C. or more and at a pressure of not lower than 5 N/cm$^2$. The treatment time is not particularly limited, however, the substrate is kept in a heated and pressed state preferably for at least 30 minutes.

(2) Abrasion Treatment

The height of the convex portion present on the surface of the substrate can be reduced by a method of rubbing with an abrasive-coated paper or an abrasive. For example, a region including the convex portion can be rubbed off with No. 2000 count abrasive-coated paper by fingers. A method of similarly using an abrasive is not particularly limited. The above-described hot pressing and abrasion treatment can be simultaneously used.

—Coating-Forming Step and Surface Layer—

The step of forming a coating is carried out by forming a coating from a resin solution containing a resin composition on the outer periphery of the substrate. For formation of a coating, known coating method such as spray coating or blade coating can be used, but from a practical viewpoint, dipping coating is preferably used. The coating just after application is in a wet state and fluidic, and thus the thermal treatment (for example, drying or primary curing) conducted first after formation of the coating is preferably treatment that prevents the surface of the coating from becoming uneven in the peripheral direction due to fluidization of the coating. For example, when the first thermal treatment is carried out after formation of a coating by applying a resin solution onto the outer periphery of the substrate, which is fixed to the outer periphery of a cylindrical core, the thermal treatment is preferably carried out while the cylindrical core is rotated in the peripheral direction.

The resin composition contained in the resin solution is preferably a resin composition capable of lowering the energy of the surface of the surface layer. Such resin composition is preferably a fluorocarbon siloxane rubber composition forming fluorocarbon siloxane rubber through curing under heating, and the main chain preferably has a perfluoroalkyl ether structure and/or a perfluoroalkyl structure.

The fluorocarbon siloxane rubber composition preferably contains the following components (A) to (E).

Component (A) is a fluorocarbon polymer based on fluorocarbon siloxane having a repeating unit represented by any one of formulae (1) to (3) below and having an aliphatic unsaturated group.

(1)

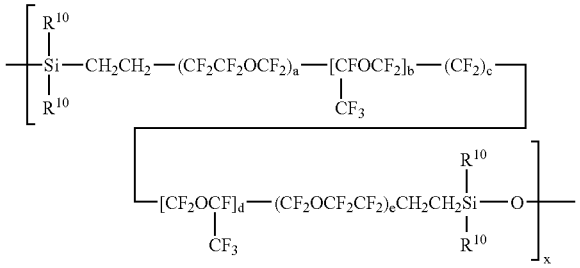

In formula (1), $R^{10}$ represents a substituted or unsubstituted monovalent hydrocarbon group, x represents an integer of 1 or more, a and e each represent 0 or 1, b and d each represent an integer from 1 to 4, and c represents an integer from 0 to 8. Examples of the compound of formula (1) include, for example, the following compound (1-1).

(1-1)

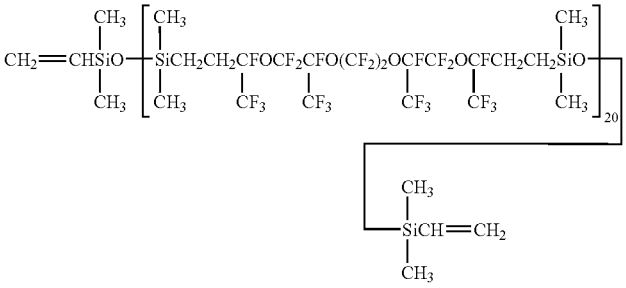

-continued (2)

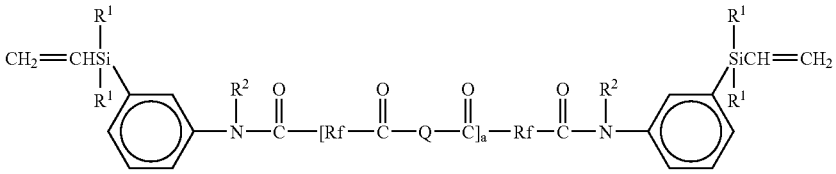

In formula (2), $R^1$ represents a substituted or unsubstituted monovalent hydrocarbon group, $R^2$ represents a hydrogen atom or a substituted or unsubstituted monovalent hydrocarbon group, Q represents a group represented by the following formula (Q1) or (Q2), Rf represents a divalent perfluoroalkylene group or a divalent perfluoropolyether group, and a represents an integer of 0 or more.

(Q1)

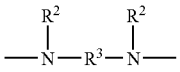

In formula (Q1), $R^3$ represents a substituted or unsubstituted divalent hydrocarbon group having one or more kinds of atoms selected from oxygen atom, nitrogen atom and silicon atom in the bonding thereof, and $R^2$ represents the same group as defined above.

(Q2)

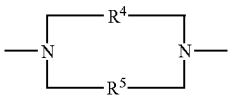

In formula (Q2), $R^4$ and $R^5$ each represent a substituted or unsubstituted divalent hydrocarbon group.

$$CH_2{=}CH{-}(X)a\text{-}Rf^1{-}(X')a\text{-}CH{=}CH_2 \quad (3)$$

In formula (3), X represents $-CH_2-$, $-CH_2O-$, $-CH_2OCH_2-$ or $-Y-NR^6-CO-$ wherein Y represents $-CH_2-$ or an o-, m- or p-dimethylsilylphenylene group represented by the following structural formula (Z), and $R^6$ represents a hydrogen atom or a substituted or unsubstituted monovalent hydrocarbon group; X' represents $-CH_2-$, $-OCH_2-$, $-CH_2OCH_2-$ or $-CO-NR^7-Y'-$ wherein Y' represents $-CH_2-$ or an o-, m- or p-dimethylsilylphenylene group represented by the following structural formula (Z'), and $R^7$ represents a hydrogen atom or a substituted or unsubstituted monovalent hydrocarbon group; $Rf^1$ represents a divalent perfluoropolyether group represented by the following formula (i) or (ii); and a independently represents 0 or 1.

(Z)

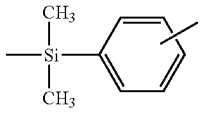

(Z')

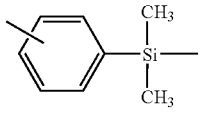

(i)

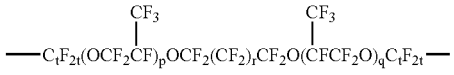

In formula (i), p and q each represents an integer from 1 to 150, and the average of p+q is 2 to 200, r represents an integer from 0 to 6, and t represents 2 or 3.

(ii)

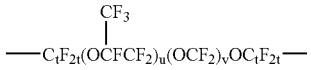

In formula (ii), u represents an integer of 1 to 200, v represents an integer of 1 to 50, and t represents 2 or 3. Specific examples of the compound of formula (3) include compounds represented by the following structural formulae:

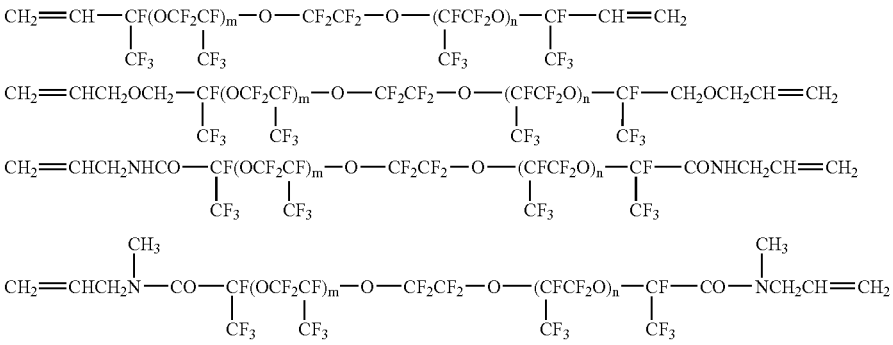

-continued

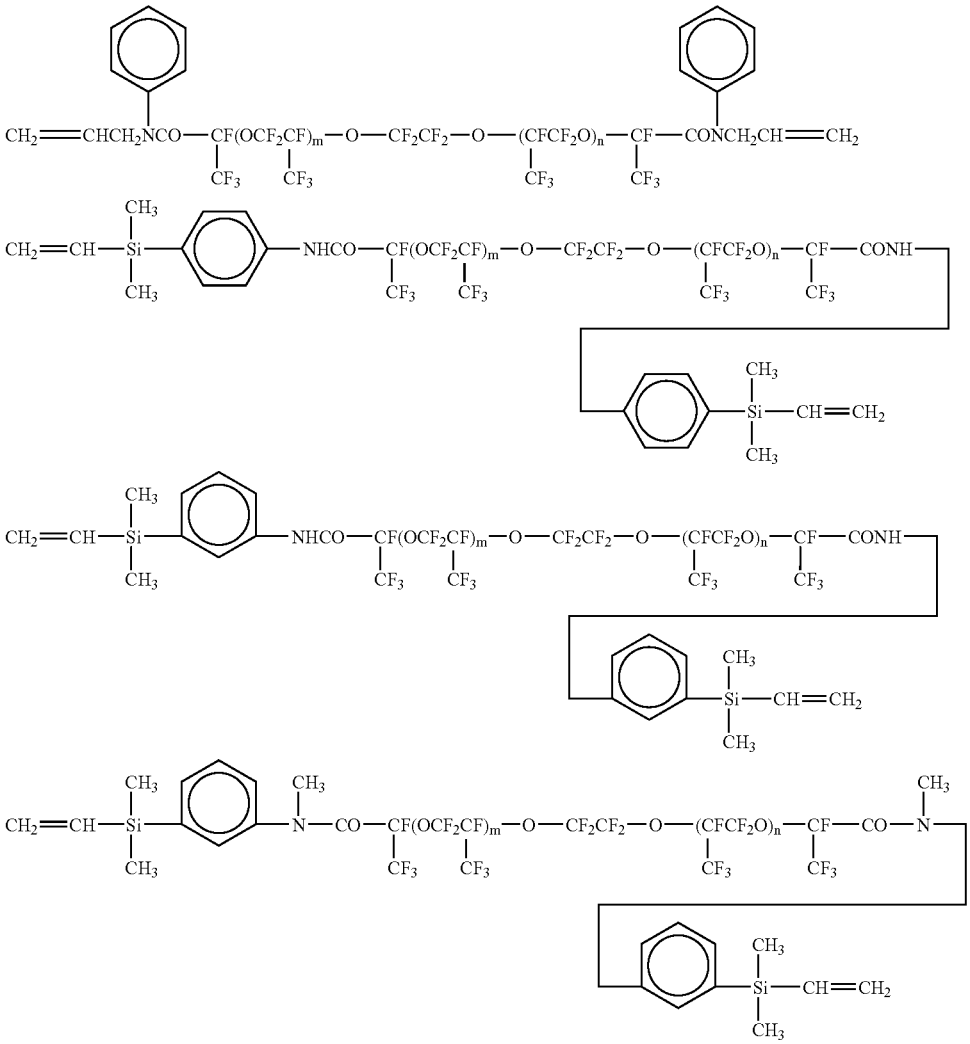

In the above structural formulae, each of m and n represents an integer from 0 to 200 satisfying the equation: m+n=6 to 200.

Component (B) is an organic silicon compound as a component having at least one monovalent perfluoroxyalkyl group, monovalent perfluoroalkyl group, divalent perfluoroxyalkylene group or divalent perfluoroalkylene group in one molecule, and having two or more silicon-bound hydrogen atoms.

Examples include organopolysiloxane represented by any one of the following formulae (B-1) to (B-4).

(B-1)

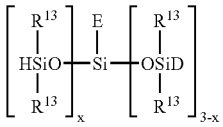

(X = 1 or 2)

-continued (B-2)

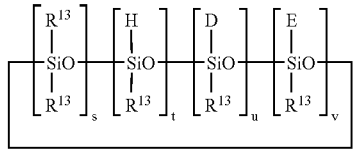

(B-3)

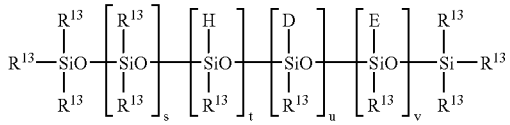

(B-4)

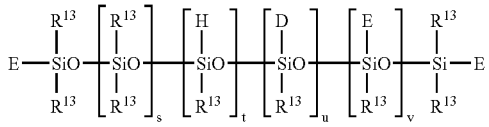

In formulae (B-1) to (B-4), $R^{13}$ represents a substituted or unsubstituted monovalent hydrocarbon group, D represents a cyclic carboxylic acid anhydride residue bound via a carbon atom to a silicon atom, E represents a perfluoroxyalkyl or perfluoroalkyl group bound via a carbon atom to a silicon atom, s represents an integer of 0 or more, each of t, u and v represents an integer of 1 or more, and s+t+u+v represents 3 to 50.

Component (C) is a filler.

Component (D) is a catalyst.

Component (E) is an organosiloxane having at least one perfluoroalkyl or perfluoroxyalkyl group bound via a carbon atom to a silicon atom.

Examples thereof include organopolysiloxane represented by any one of the following formulae (B-5) to (B-7).

(B-5)

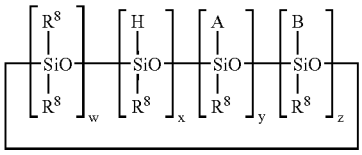

(B-6)

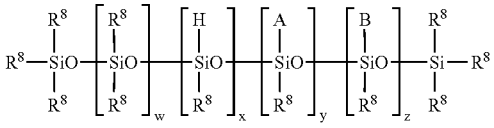

(B-7)

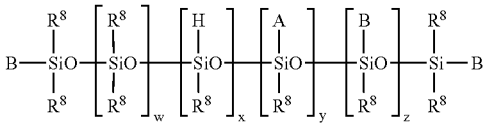

In formulae (B-5) to (B-7), $R^8$ represents a substituted or unsubstituted monovalent hydrocarbon group; A represents an epoxy group and/or a trialkoxysilyl group, which are bound to a silicon atom via a carbon atom or via a carbon atom and an oxygen atom; B represents a perfluoroxyalkyl or perfluoroalkyl group bound via a carbon atom to a silicon atom; each of w and z represents an integer of 0 or more; each of x and y represents an integer of 1 or more; and w+x+y+z represents 2 to 60.

The filler can be selected from various fillers used in general silicone rubber compositions. Such fillers include, for example, reinforcing fillers such as aerosol silica, precipitated silica, carbon black, carbon powder, titanium dioxide, aluminum oxide, quartz powder, talc, sericite and bentonite and fibrous fillers such as asbestos, glass fiber and organic fiber.

As the catalyst, a known catalyst capable of accelerating the reaction and curing of the components in the above items (A) and (B) under heating, and for example, a platinum catalyst can be used in an amount necessary for accelerating curing.

Examples of fluorocarbon siloxane rubber composition containing the materials shown in the above items (A), (B), (D) and (E) include SIFEL manufactured by Shin-Etsu Chemical Co., Ltd. In the invention, such commercial product can be used directly as a fluorocarbon siloxane rubber composition, but it is preferable to add, to such a commercial product, a filler of component (C) as necessary, and use thus obtained composition as a fluorocarbon siloxane rubber composition.

As the solvent used in the resin solution, a solvent capable of dissolving the resin composition can be used as necessary. For example, a fluorine-based solvent can be used as the solvent in the resin solution containing a fluorine-based resin composition such as the above-mentioned fluorocarbon siloxane rubber composition as a resin composition.

As the fluorine-based solvent, known fluorine-based solvents can be used, and specific examples include methaxylene hexafluoride ($C_6H_4(CF_3)_2$), perfluoro(2-butyltetrahydrofuran) ($C_8F_{16}O$), perfluoroalkane ($C_8F_{18}$), octafluorocyclopentane, hydrofluoroether, and the like. These solvents have low surface tension and are thus excellent in wetting properties, and used generally in cleaning precision parts and semiconductors.

<Fixing Apparatus and Image-forming Apparatus>

Now, the fixing apparatus and image-forming apparatus utilizing the fixing method of the invention are described.

The fixing apparatus of the invention comprises the fixing belt described above, a pair of fixing members having the fixing belt sandwiched therebetween and pressed against each other so as to form a fixing portion that heats and presses a recording medium having a toner image formed thereon, at least one of which has a heating function, and a cooling portion that cools the recording medium after the recording medium has passed through the fixing portion, during which the recording medium is conveyed in a state in which the recording medium is retained on the surface of the fixing belt. The fixing belt more preferably has the characteristics of both fixing belts used in the first and second fixing methods.

In the section between the fixing portion and the cooling portion, the recording medium is conveyed in a state where the surface of the recording medium on which a toner image is formed is contacted with the surface of the fixing belt, and the length of the cooling portion (length in the direction of conveying the recording medium) may be a length necessary for solidifying the toner image molten and softened by heating and pressing in the fixing portion. Solidification of the softened toner image can be effected by a method of either forced cooling using, for example, a heat sink, or natural cooling, however, from the viewpoint of downsizing the fixing apparatus, the softened toner image is solidified preferably by forced cooling.

Figure 2:
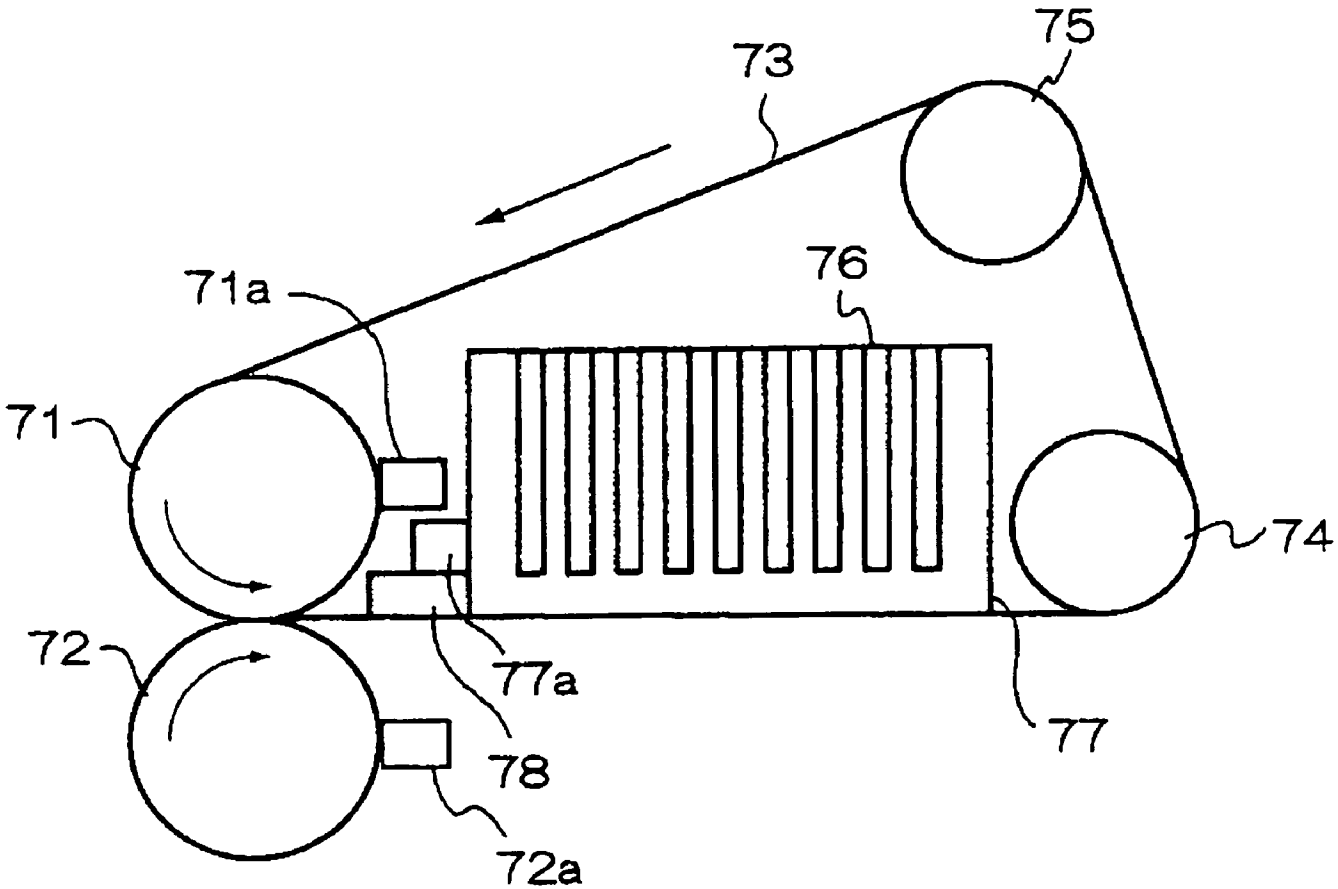
FIG. 2 is a schematic sectional view showing an example of the structure of the fixing apparatus of the invention.

A specific example of such fixing apparatus is described by reference to the drawing. FIG. 2 is a schematic sectional view showing an example of the structure of the apparatus of the invention, and in FIG. 2, reference numeral 71 denotes a heating roll, 71*a* denotes a heating roll temperature sensor, 72 denotes a pressing roll, 72*a* denotes a pressing roll temperature sensor, 73 denotes a fixing belt (endless belt), 74 denotes a release roll, 75 denotes a tension roll, 76 denotes a ventilation duct, 77 denotes a heat sink, 77*a* denotes a heat sink top temperature sensor, and 78 denotes a belt press member.

In the fixing apparatus shown in FIG. 2, the endless belt 73 is stretched over the heating roll 71, release roll 74 and tension roll 75, which are arranged in contact with the inner periphery of the endless belt 73 in the anticlockwise direction and can be rotated in the arrowed direction in FIG. 2. The heating roll 71 and the pressing roll 72 having the endless belt 73 sandwiched therebetween are arranged opposite to each other, and a recording medium (not shown) can be inserted between the outer periphery of the endless belt 73 and the pressing roll 72.

The heating roll 71 and pressing roll 72 have a built-in heating source such as halogen lamp (not shown), and the heating temperature of these roll surfaces is regulated so as to be a suitable temperature by monitoring with a heating roll temperature sensor 71*a* arranged on the outer periphery of the heating roll 71 and with a pressing roll temperature sensor 72*a* arranged on the outer periphery of the pressing roll 72.

On the inner periphery of the endless belt 73 between the heating roll 71 and release roll 74, the belt press member 78, and the heat sink 77 provided with a ventilation duct 76 for cooling the 3 rolls and the endless belt 73 are arranged in this order along the rotation direction of the endless belt 73. A heat sink top temperature sensor 77*a* is arranged in contact with the side of the heat sink 77 on which the heating roll 71 is arranged.

In thermal fixing treatment using this fixing apparatus, a recording medium (not shown) onto which a toner image has been transferred is conveyed by a conveying means not shown, and inserted into an abutted portion (fixing portion) between the outer periphery of the endless belt 73 and the pressing roll 72 and passed therethrough such that the surface on which the toner image is formed is contacted with the outer periphery of the endless belt 73. In this treatment, when the recording medium is passed through the abutted portion, the toner image is fixed on the surface of the recording medium by heating and pressing.

Thereafter, the recording medium subjected to thermal fixing treatment, while contacting with the outer periphery of the endless belt 73, is conveyed to the position in which the release roll 74 is arranged. While the recording medium moves from the fixing portion to the release portion, the molten toner image fixed on the surface of the recording medium is solidified by forced cooling on the outer periphery (cooling portion) of the endless belt 73 whose inner periphery is contacted with the heat sink 77. Subsequently, the recording medium conveyed to the position in which the release roll 74 is arranged, is released from the outer periphery of the endless belt 73 and then discharged to the outside of the apparatus.

As the recording medium, a recording medium including an image-receiving layer containing thermoplastic resin can be utilized. In this case, the image-receiving layer becomes softened or molten during fixing, and the toner image transferred to the image-receiving layer is fixed in a state that the toner image is embedded in the image receiving layer. After fixing, the image receiving layer retained on the outer periphery of the endless belt 73 is conveyed to the release roll 74 and released from the endless belt 73 by the curvature of the release roll 74 upon rolling up the endless belt 73 by the release roll 74.

When the endless belt 73 used in this fixing apparatus is the fixing belt used in the first fixing method, the surface of the fixing belt (surface of the surface layer) is excellent in smoothness without showing an orange peel state, and thus the surface of an image formed after fixing can be made super-smooth to give an image excellent in mirror surface properties. When the endless belt 73 is the fixing belt used in the second fixing method, the surface layer has no convex portion (0 convex portion per surface) having a filtered maximum waviness of higher than 50 μm, and thus generation of white-spot defects can be suppressed.

Now, the image forming apparatus using the fixing apparatus of the invention is described in detail. The image forming apparatus is not particularly limited insofar as it is an image-forming apparatus in an electrophotographic system provided with the fixing apparatus of the invention, and specifically the image forming apparatus preferably comprises at least an image holding member, a charging apparatus that charges the surface of the image holding member, a latent image forming apparatus that forms a latent image on the charged surface of the image holding member, a developing apparatus that develops the latent image with a developer to form a toner image, a transfer apparatus that transfers the toner image to a transfer material, and a fixing apparatus that thermally fixes the toner image on a recording medium. As the fixing apparatus in such structure, the fixing apparatus of the invention is used.

Figure 3:
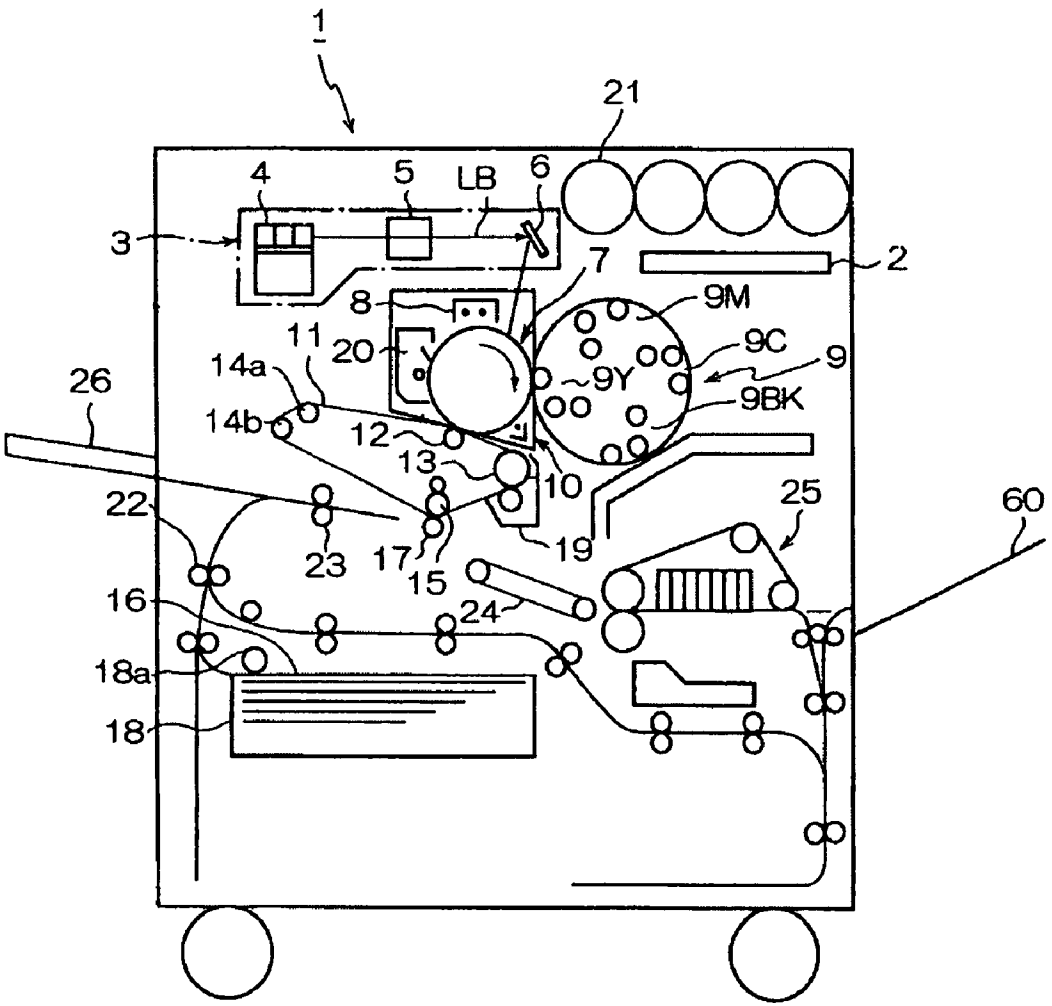
FIG. 3 is a schematic sectional view showing a specific example of the image forming apparatus of the invention.

A specific example of the image forming apparatus provided with the fixing apparatus of the invention is described by reference to the drawing. FIG. 3 is a schematic sectional view showing a specific example of the image forming apparatus of the invention, and in FIG. 3, reference numeral 1 denotes an image forming apparatus, 2 denotes an image processing apparatus, 3 denotes a raster output scanner (ROS), 4 denotes a rotating polyhedral mirror, 5 denotes an f·θ lens, 6 denotes a reflecting mirror, 7 denotes a photoreceptor drum, 8 denotes a scorotron (charging device), 9 (9Y, 9M, 9C, 9BK) denotes a developing apparatus, 10 denotes a pre-transfer charging device, 11 denotes an intermediate transfer belt, 12 denotes a primary transfer roll, 13 denotes a driving roll, 14*a* denotes a follow-up roll, 14*b* denotes a tension roll, 15 denotes a backup roll, 16 denotes a recording sheet, 17 denotes a secondary transfer roll, 18 denotes a paper feeding cassette, 18*a* denotes a feed roll, 19 denotes an intermediate transfer belt cleaning unit, 20 denotes a photoreceptor cleaning unit, 21 denotes a developer container, 22 denotes a conveying roll, 23 denotes a resist roll, 24 denotes a conveying belt, 25 denotes a first fixing apparatus, 26 denotes a manually paper feeding portion (paper feeding tray), and 60 denotes a discharge tray.

The scorotron 8, developing apparatus 9, pre-transfer charging device 10, primary transfer roll 12 (primary transfer portion) arranged via intermediate transfer belt 11, and photoreceptor cleaning unit 20 are arranged along the clockwise direction (rotating direction) around the photoreceptor drum 7. By a laser light emitted from ROS 3 having the rotating polyhedral mirror 4, f·θ lens 5 and reflecting mirror 6, a latent image corresponding to image information can be formed on the surface of the photoreceptor drum 7 between the scorotron 8 and the developing apparatus 9. The developing apparatus 9 communicates with the developer container 21, and can be supplied suitably with a developer from the developer container 21.

For formation of an image, the surface of the photoreceptor drum 7 is charged by the scorotron 8, and on the surface of the charged photoreceptor drum 7, a latent image is formed by a laser light emitted from ROS 3. Subsequently, the latent image is developed with a developer by the developing apparatus 9 to form a toner image which is then transferred to the outer periphery of the intermediate transfer belt 11. Toners remaining on the photoreceptor drum 7 after transfer are removed by the photoreceptor cleaning unit 20.

The intermediate transfer unit, including the intermediate transfer belt 11, and on the inner periphery thereof, the primary transfer roll 12, driving roll 13, backup roll 15, follow-up roll 14*a* and tension roll 14*b* arranged in the clockwise direction for stretching the intermediate transfer belt 11, is arranged below the photoreceptor drum 7. The intermediate transfer belt cleaning unit 19 arranged via the intermediate transfer belt 11 against the driving roll 13, and the secondary transfer roll 17 arranged via the intermediate transfer belt 11 against the backup roll 15, are arranged on the outer periphery of the intermediate transfer belt 11.

The recording medium can be inserted into and passed through between the secondary transfer roll 17 and the outer periphery of the intermediate transfer belt 11 (secondary transfer portion). Conveyance and supply of a recording sheet (recording medium) 16 stored in the paper feeding cassette 18 into the secondary transfer portion can be automatically conducted via feed roll 18*a*, conveying roll 22 and resist roll 23, or conveyance and supply from the paper feeding tray 26 can be carried out via resist roll 23.

A conveying belt 24 for conveying the recording sheet 16 having a toner image transferred thereto, a first fixing apparatus 25 for fixing the recording sheet 16 conveyed by the conveying belt 24, and a discharge tray 60 for discharging the recording sheet 16 having an image formed after fixing, into the outside of the apparatus, are arranged in the opposite side (side from which the recording sheet 16 is discharged) to the side of the secondary transfer portion on which these 2 paper feeding means are arranged. As the first fixing apparatus 25, the fixing apparatus of the invention shown in FIG. 2 is used.

The toner image transferred onto the outer periphery of the intermediate transfer belt 11 in the primary transfer portion is conveyed to the secondary transfer portion by rotation of the intermediate transfer belt 11 in the anticlockwise direction, and transferred onto the recording sheet 16 in the secondary transfer portion. The recording sheet 16 onto which the toner image has been transferred is conveyed with the conveying belt 24 to the fixing apparatus 25, and as described above, the toner image is heated and fixed on the surface of the recording sheet 16 to form an image. Thereafter, the recording sheet on which the image is formed is discharged into the discharge tray 60.

Figure 4:
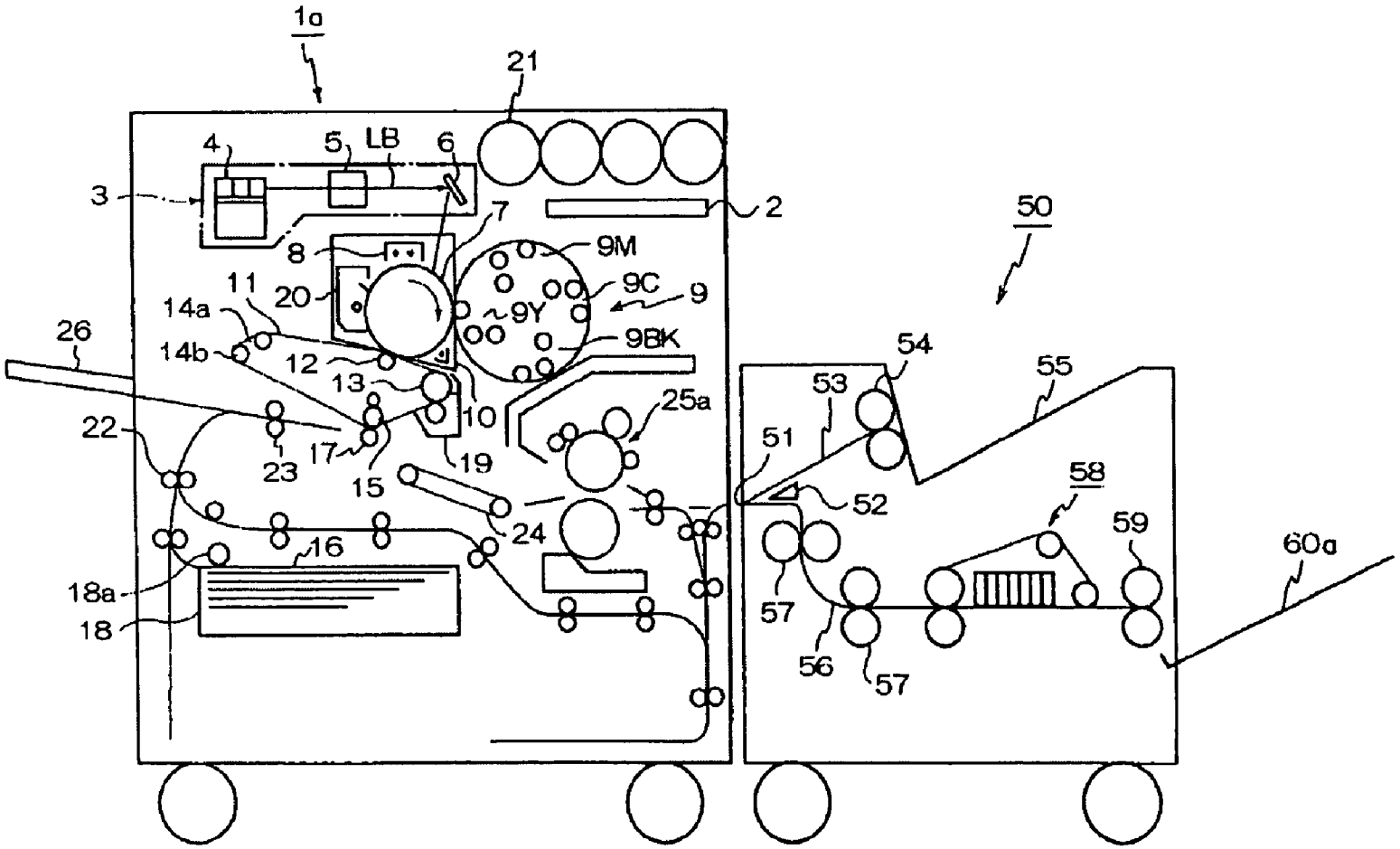
FIG. 4 is a schematic sectional view showing another specific example of the image forming apparatus of the invention.

FIG. 4 is a schematic sectional view showing another example of the structure of the image forming apparatus of the invention. In FIG. 4, members common to those of the image forming apparatus shown in FIG. 3 are provided with the same symbols as in FIG. 3, and reference numeral 1*a* denotes an image forming apparatus, 25*a* denotes a primary fixing apparatus, 50 denotes a secondary fixing unit, 51 denotes an inlet, 52 denotes a switching gate, 53 denotes a conveying path, 54 denotes a discharge roll, 55 denotes a discharge tray, 56 denotes a second conveying path, 57 denotes a conveying roll, 58 denotes a second fixing apparatus, 59 denotes a discharge roll, and 60*a* denotes a discharge tray.

The image forming apparatus 1*a* shown in FIG. 4 has the same structure as in the image forming apparatus 1 except that a primary fixing apparatus 25*a* is included in place of the first fixing apparatus 25 in the image forming apparatus 1 shown in FIG. 3, and a secondary fixing unit 50 is externally attached to the position where the discharge tray 60 is arranged in the image forming apparatus 1.

The secondary fixing unit 50 is provided with an inlet 51 for receiving a recording sheet 16 discharged from the primary fixing apparatus 25*a*. The recording sheet conveyed via the inlet 51 into the secondary fixing unit 50 is sent by the switching gate 52 to either the conveying path 52 or the second conveying path 56.

When the recording sheet 16 has been subjected to fixing treatment in the primary fixing apparatus 25*a*, the recording sheet 16 is sent to the conveying path 53 and discharged via discharge roll 54 to discharge tray 55 arranged on the upper surface of the secondary fixing unit 50.

On the other hand, when the toner image on the recording sheet 16 is not fixed, the recording sheet is sent to the second conveying path 56, passed through the conveying roll 57, then the toner image is thermally fixed on the recording sheet 16 by the second fixing apparatus 58, and the recording sheet is passed through the discharge roll 59 and discharged from the discharge tray 60*a* arranged on the side of the secondary fixing unit 50.

As the second fixing apparatus 58 of the secondary fixing unit 50, the fixing apparatus of the invention shown in FIG. 2 is used, and by switching the conveying path, fixing treatment can be selectively conducted by using the fixing apparatus of the invention.

EXAMPLES

Hereinafter, the invention is described in more detail by reference to the Examples, but the invention is not limited to the Examples. In the following description, "parts" means "parts by weight".

Example A1

—Preparation of a Substrate—

To U-VARNISH S (manufactured by UBE Industries, Ltd.; containing 80 wt % N-methyl-2-pyrrolidone and 20 wt % polyamic acid), carbon black is added in an amount of 15 parts relative to 100 parts of the solids content of U-VARNISH S, and the mixture is dispersed for 2 hours with a beads mill, to give a polyimide precursor solution.

Then, the polyimide precursor solution is poured into a centrifugal forming cylindrical mold having an inner diameter of 170.1 mm rotating at low speed, and then heated to 120° C. at a revolution number of 300 rpm and kept for 1 hour to give a substrate precursor.

The substrate precursor is removed from the mold, then inserted into an aluminum baking mold, heated in an oven at a rate of 2° C./min. to 340° C. at which the precursor is kept for 30 minutes, and then cooled at a rate of 2° C./min. to 40° C., and then removed from the oven, and after removal from the mold, the sample is cut into pieces of 370 mm in width to give a polyimide substrate of 100 μm in thickness in the form of an endless belt. The resulting polyimide substrate of 100 μm in thickness is inserted into a cylindrical form and masked at both ends with a tape. Thereafter, the substrate is degreased by ultrasonic washing with acetone.

—Formation of a Surface Layer—

A coating solution prepared by mixing 70 wt % SIFEL 610 (manufactured by Shin-Etsu Chemical Co., Ltd.) with 30 wt % fluorine-based solvent X-70-580 (manufactured by Shin-Etsu Chemical Co., Ltd.) is prepared.

Then, the cylindrical form in which the polyimide substrate has been set is dipped in a coating bath filled with this coating solution and then raised at a rate of 100 mm/min. thereby forming a coating on the outer periphery of the substrate.

Thereafter, the coating is subjected to primary thermal curing for 30 minutes while the cylindrical form with the axial direction in a horizontal state is rotated at a revolution rate of 100 rpm in the direction of periphery in an oven at 120° C. such that the coating formed on the surface of the polyimide substrate is not deformed by flowing. Then, the cylindrical form is arranged perpendicularly in a high-temperature oven at 200° C. and subjected to secondary heating for 4 hours to form a surface layer of fluorocarbon siloxane rubber of 25 μm in thickness to give a fixing belt.

Example A2

—Preparation of a Substrate—

The same substrate as in Example A1 is used.

—Preparation of a Surface Layer—

A coating solution prepared by mixing 70 wt % SIFEL 610 (manufactured by Shin-Etsu Chemical Co., Ltd.) with 30 wt % fluorine-based solvent X-70-580 (manufactured by Shin-Etsu Chemical Co., Ltd.) is prepared.

Then, a cylindrical form in which the polyimide substrate has been set is dipped in a coating bath filled with this coating solution and then raised at a rate of 300 mm/min. thereby forming a coating on the outer periphery of the substrate.

Thereafter, the coating is subjected to primary thermal curing for 30 minutes while the cylindrical form with the axial direction in a horizontal state is rotated at a revolution rate of 10 rpm in the direction of periphery in an oven at 120° C. such that the coating formed on the surface of the polyimide substrate is not deformed by flowing. Then, the cylindrical form is arranged perpendicularly in a high-temperature oven at 200° C. and subjected to secondary heating for 4 hours to form a surface layer of fluorocarbon siloxane rubber of 43 μm in thickness to give a fixing belt.

Comparative Example A1

—Preparation of a Substrate—

As the polyimide substrate, a substrate prepared in the same manner as in Example A1 is used. This polyimide substrate is inserted into a cylindrical form and masked at both ends with a tape. Thereafter, the substrate is degreased by ultrasonic cleaning with acetone.

—Preparation of a Surface Layer—

A coating solution prepared by mixing 70 wt % SIFEL 610 (manufactured by Shin-Etsu Chemical Co., Ltd.) with 30 wt % fluorine-based solvent X-70-580 (manufactured by Shin-Etsu Chemical Co., Ltd.) is prepared.

Subsequently, a fixing belt is obtained in the same manner as in Example A1 except that at the time of primary thermal curing, the cylindrical form after formation of a coating is left perpendicularly in an oven.

<Evaluation>

—Evaluation of the Fixing Belt—

The ten-point average roughness (Rz) of the outer periphery of the resulting fixing belt is measured, and the state of the outer periphery of the fixing belt is observed with the naked eye. In the method of observation with the naked eye, an image reflecting a fluorescence lamp is observed on the flat portion of the biaxially stretched belt, and the state of orange peel on the outer periphery is observed and evaluated under the following criteria. The results are shown in Table 1.

A: No orange peel is observed.

B: Orange peel is remarkably observed.

—Evaluation of an Image—

An image forming apparatus (DOCUCENTRE COLOR F450, manufactured by Fuji Xerox Co., Ltd.) having the fixing apparatus shown in FIG. 2 is used to form an image, and the mirror surface properties of the surface of the resulting image are evaluated with the naked eye by observing an image reflecting a fluorescent lamp. The surface state of the image is also evaluated from an image reflecting a fluorescent lamp and evaluated under the following criteria. The results are shown in Table 1.

A: The outline of a fluorescent tube reflected on the surface of the image is clearly observed.

B: The outline of a fluorescent tube reflected on the surface of the image is almost clearly observed.

C: The outline of a fluorescent tube reflected on the surface of the image is slightly hazy, but the shape of a fluorescent tube can be recognized.

D: The outline of a fluorescent tube reflected on the surface of the image is significantly hazy, and the shape of a fluorescent tube cannot be recognized.

For formation of an image, a paper having an image receiving layer of thermoplastic resin into which toners are embedded (digital coat paper, manufactured by Fuji Xerox Co., Ltd.) is used to form an image. For fixing, the surface temperature of the heating roller and the pressing roller are set at 140° C. This surface temperature is a temperature at which the thermoplastic resin in the image receiving layer of the paper becomes softened or melted, so that at the time of thermal fixing, the image receiving layer becomes softened or melted, and the toner image transferred onto the image receiving layer is fixed and simultaneously embedded in the image receiving layer.

TABLE 1

| | Surface of fixing belt | | Surface state of image |
|---|---|---|---|
| | Ten-point average roughness (Rz) (μm) | Surface state by visual check | (mirror surface properties) |
| Example A1 | 0.685 | A | B |
| Example A2 | 0.480 | A | A |
| Comparative Example A1 | 0.910 | B | D |

Example B1

—Polyimide Belt Substrate—

To U-VARNISH S (manufactured by UBE Industries, Ltd.; containing 80 wt % N-methyl-2-pyrrolidone and 20 wt % polyamic acid), carbon black is added in an amount of 15 parts relative to 100 parts of the solids content of U-VARNISH S, and the mixture is dispersed for 2 hours with a beads mill, to give a polyimide precursor solution.

Then, the polyimide precursor solution is poured into a centrifugal forming cylindrical mold having an inner diameter of 170.1 mm rotating at low speed, and then heated to 120° C. at a revolution number of 300 rpm and kept for 1 hour to give a substrate precursor.

The substrate precursor is removed from the mold, then inserted into an aluminum baking mold, heated in an oven at a rate of 2° C./min. to 340° C. at which the precursor is kept for 30 minutes, and then cooled at a rate of 2° C./min. to 40° C., and then removed from the oven, and after removal from the mold, the sample is cut into pieces of 370 mm in width to give a polyimide substrate of 100 μm in thickness in the form of an endless belt.

—Treatment of the Polyimide Belt Substrate—

The outer periphery of the polyimide substrate thus obtained is observed with the naked eye and measured for filtered maximum waviness of portions having convex portions, and all convex portions having a filtered maximum waviness of greater than 50 μm are abraded with #2000 abrasive paper.

—Surface Layer—

Then, a coating solution prepared by mixing 70 wt % SIFEL 610 (manufactured by Shin-Etsu Chemical Co., Ltd.) with 30 wt % fluorine-based solvent X-70-580 (manufactured by Shin-Etsu Chemical Co., Ltd.) is prepared.

Then, the substrate is dipped in a coating bath filled with this coating solution, and then raised at a rate of 200 mm/min. thereby forming a coating on the outer periphery of the substrate, and the coating is subjected to primary thermal curing at 120° C. for 20 minutes such that the once formed coating is not deformed by flowing, and then the coating is subjected to secondary heating at 200° C. for 4 hours to form a surface layer of fluorocarbon siloxane rubber of 25 μm in thickness to give a fixing belt.

Example B2

The outer periphery of a polyimide substrate obtained in the same manner as in Example B1 is observed with the naked eye and measured for filtered maximum waviness of the portions having convex portions, and all convex portions having a filtered maximum waviness of greater than 35 μm are abraded with #2000 abrasive paper. A fixing belt is obtained in the same manner as in Example B1 except for the above procedure.

Example B3

The outer periphery of a polyimide substrate obtained in the same manner as in Example B1 is observed with the naked eye and measured for filtered maximum waviness of the portions having convex portions thereby determining convex portions having a filtered maximum waviness of greater than 50 μm.

Then, the polyimide substrate with the outer periphery directed upwards is arranged on a flat stainless steel plate, and a weight of 0.5 kg having a bottom of 1 mm in diameter is arranged on a convex portion having a filtered maximum waviness of greater than 50 μm, to apply a loading of 1.6 $N/cm^2$, and under this condition, the substrate is hot-pressed by leaving it for 60 minutes in an oven at 150° C., then cooled and removed from the oven. A fixing belt is obtained in the same manner as in Example B1 except for the above procedure.

Example B4

The outer periphery of a polyimide substrate obtained in the same manner as in Example B1 is observed with the naked eye and measured for filtered maximum waviness of the convex portions, and convex portions having a filtered maximum waviness of greater than 50 μm are determined.

Then, a convex portion having a filtered maximum waviness of greater than 50 μm is subjected to abrasion treatment in the same manner as in Example B1, and then hot-pressed in the same manner as in Example B3. A fixing belt is obtained in the same manner as in Example B1 except that the above procedure is conducted.

Comparative Example B1

A fixing belt is obtained in the same manner as in Example B1 except that the outer periphery of a polyimide substrate obtained in the same manner as in Example B1 is not subjected to any abrasion treatment or hot pressing.

<Evaluation>

—Evaluation of the Fixing Belt—

The outer periphery of the resulting fixing belt is observed with the naked eye, and all convex portions recognized with the naked eye are measured for filtered maximum waviness, and the maximum of these values is determined. The results are shown in Table 2.

—Evaluation of an Image—

Using an image forming apparatus (DOCUCENTRE COLOR F450, manufactured by Fuji Xerox Co., Ltd.) having the fixing apparatus shown in FIG. 2, a black solid image is formed on the whole surface of paper, and the presence or absence of white-spot defects on the surface of the image is confirmed with the naked eye and evaluated under the following criteria. The results are shown in Table 2.

A: White-spot defects are not observed in the image.

B: White-spot defects are slightly observed in the image, but are not remarkable and at practically unproblematic level.

C: White-spot defects are observed at practically problematic level in the image.

For formation of an image, a paper having an image receiving layer of thermoplastic resin into which toners are embedded (digital coat paper, manufactured by Fuji Xerox Co., Ltd.) is used to form an image. For fixing, the surface temperature of the heating roller and the pressing roller are set at 140° C. This surface temperature is a temperature at which the thermoplastic resin in the image receiving layer of the paper becomes softened or melted, so that at the time of thermal fixing, the image receiving layer becomes softened or melted, and the toner image transferred onto the image receiving layer is fixed and simultaneously embedded in the image receiving layer, to smooth the surface of the image.

TABLE 2

| | Treatment method and conditions of substrate surface | | Maximum value of filtered maximum waviness of all convex portions in outer periphery of fixing belt (μm) | White-spot defects in image |
|---|---|---|---|---|
| | Treatment method | Filtered maximum waviness of convex portion to be treated | | |
| Example B1 | Abrasion | 50 μm or more | 32.5 | A |
| Example B2 | Abrasion | 35 μm or more | 21.5 | A |
| Example B3 | Hot pressing | 50 μm or more | 44.5 | A |
| Example B4 | Abrasion + hot pressing | 50 μm or more | 15.5 | A |
| Comparative Example B1 | Untreated | — | 68.3 | B |

As described above, the invention can provide a fixing method capable of suppressing generation of image defects, a fixing apparatus using the same, and an image-forming apparatus.

Hereinafter, embodiments of the invention will be described. However, the invention is not limited to these embodiments.

[1] A fixing method comprising conveying a recording medium on which a toner image has been formed using a fixing belt, in a state in which the fixing belt contacts with a surface of the recording medium on which the toner image is formed, at least from a fixing portion in which the toner image is fixed by heating and pressing the recording medium to a cooling portion in which the recording medium is cooled after fixing, wherein a ten-point average roughness (Rz) of a surface of the fixing belt contacting with the recording medium is 0.7 μm or less.

[2] A fixing method described in the embodiment [1], wherein the fixing belt comprises a heat-resistant elastic body having a surface contacting with the recording medium, and a substrate disposed at a side opposite to the surface of the heat-resistant elastic body contacting with the recording medium, and the heat-resistant elastic body is formed at an outer periphery of the substrate by forming a coating by applying a resin solution onto the outer periphery of the substrate, which is fixed to an outer periphery of a cylindrical core, and thermally treating the coating at least once, wherein a first thermal treatment is carried out by rotating the cylindrical core in a peripheral direction.

[3] A fixing method comprising conveying a recording medium on which a toner image has been formed using a fixing belt, in a state in which the fixing belt contacts with a surface of the recording medium on which the toner image is formed, at least from a fixing portion in which the toner image is fixed by heating and pressing the recording medium to a cooling portion in which the recording medium is cooled after fixing, wherein a filtered maximum waviness in every convex portion present on a surface of the fixing belt contacting with the recording medium is 50 μm or less.

[4] A fixing method described in the embodiment [3], wherein the fixing belt comprises a substrate, and the fixing belt is produced by flattening a convex portion present on the surface of the substrate at a side of the fixing belt contacting with the recording medium, by hot pressing at 150° C. or more and/or abrasion treatment.

[5] A fixing method described in the embodiment [3], wherein the fixing belt comprises a heat-resistant elastic body having a surface contacting with the recording medium, and a substrate disposed at a side opposite to the surface of the heat-resistant elastic body contacting with the recording medium, and the heat-resistant elastic body is formed by forming a coating by applying a resin solution onto an outer periphery of the substrate, which is fixed to an outer periphery of a cylindrical core.

[6] A fixing method described in the embodiment [1], wherein the fixing belt comprises a heat-resistant elastic body having a surface contacting with the recording medium, and a substrate disposed at a side opposite to the surface of the heat-resistant elastic body contacting with the recording medium, and the heat-resistant elastic body comprises a fluorine-based elastomer.

[7] A fixing apparatus comprising a fixing belt, a pair of fixing members having the fixing belt sandwiched therebetween and pressed against each other so as to form a fixing portion that heats and presses a recording medium having a toner image formed thereon, at least one of which has a heating function, and a cooling portion that cools the recording medium after the recording medium has passed through the fixing portion, during which the recording medium is conveyed in a state in which the recording medium is retained on the surface of the fixing belt, wherein a ten-point average roughness (Rz) of a surface of the fixing belt contacting with the recording medium is 0.7 μm or less.

[8] A fixing apparatus described in the embodiment [7], wherein the fixing belt comprises a heat-resistant elastic body having a surface contacting with the recording medium, and a substrate disposed at a side opposite to the surface of the heat-resistant elastic body contacting with the recording medium, and the heat-resistant elastic body is formed on the substrate by forming a coating by applying a resin solution onto an outer periphery of the substrate, which is fixed to an outer periphery of a cylindrical core, and thermally treating the coating at least once, wherein a first thermal treatment is carried out by rotating the cylindrical core in a peripheral direction.

[9] A fixing apparatus comprising a fixing belt that conveys a recording medium on which a toner image has been formed, in a state in which the fixing belt contacts with a surface of the recording medium on which the toner image is formed, at least from a fixing portion in which the toner image is fixed by heating and pressing the recording medium to a cooling portion in which the recording medium is cooled after fixing, wherein a filtered maximum waviness in every convex portion present on a surface of the fixing belt contacting with the recording medium is 50 μm or less.

[10] A fixing apparatus described in the embodiment [9], wherein the fixing belt comprises a substrate, and the fixing belt is produced by flattening a convex portion present on the surface of the substrate at a side of the fixing belt contacting with the recording medium, by hot pressing at 150° C. or more and/or abrasion treatment.

[11] A fixing apparatus described in the embodiment [9], wherein the fixing belt comprises a heat-resistant elastic body having a surface contacting with the recording medium, and a substrate disposed at a side opposite to the surface of the heat-resistant elastic body contacting with the recording medium, and the heat-resistant elastic body is formed by forming a coating by applying a resin solution onto an outer periphery of the substrate, which is fixed to an outer periphery of a cylindrical core.

[12] A fixing apparatus described in the embodiment [9], wherein the fixing belt comprises a heat-resistant elastic body having a surface contacting with the recording medium, and a substrate disposed at a side opposite to the surface of the heat-resistant elastic body contacting with the recording medium, and the heat-resistant elastic body comprises a fluorine-based elastomer.

[13] An image forming apparatus comprising at least an image holding member, a charging apparatus that charges a surface of the image holding member, a latent image forming apparatus that forms a latent image on the charged surface of the image holding member, a developing apparatus that develops the latent image with a developer to form a toner image, a transfer apparatus that transfers the toner image to a transfer material, and a fixing apparatus that thermally fixes the toner image on a recording medium, wherein the fixing apparatus comprises a fixing belt, a pair of fixing members having the fixing belt sandwiched therebetween and pressed against each other so as to form a fixing portion that heats and presses a recording medium having a toner image formed thereon, at least one of which has a heating function, and a cooling portion that cools the recording medium after the recording medium has passed through the fixing portion, during which the recording medium is conveyed in a state in which the recording medium is retained on the surface of the fixing belt, wherein a ten-point average roughness (Rz) of a surface of the fixing belt contacting with the recording medium is 0.7 μm or less.

[14] An image-forming apparatus described in the embodiment [13], wherein the fixing belt comprises a heat-resistant elastic body having a surface contacting with the recording medium, and a substrate disposed at a side opposite to the surface of the heat-resistant elastic body contacting with the recording medium, and the heat-resistant elastic body is formed at an outer periphery of the substrate by forming a coating by applying a resin solution onto the outer periphery of the substrate, which is fixed to an outer periphery of a cylindrical core, and thermally treating the coating at least once, wherein a first thermal treatment is carried out by rotating the cylindrical core in a peripheral direction.

[15] An image forming apparatus comprising at least an image holding member, a charging apparatus that charges a surface of the image holding member, a latent image forming apparatus that forms a latent image on the charged surface of the image holding member, a developing apparatus that develops the latent image with a developer to form a toner image, a transfer apparatus that transfers the toner image to a transfer material, and a fixing apparatus that thermally fixes the toner image on a recording medium, wherein the fixing apparatus comprises a fixing belt that conveys a recording medium on which a toner image has been formed, in a state in which the fixing belt contacts with a surface of the recording medium on which the toner image is formed, at least from a fixing portion in which the toner image is fixed by heating and pressing the recording medium to a cooling portion in which the recording medium is cooled after fixing, wherein a filtered maximum waviness in every convex portion present on a surface of the fixing belt contacting with the recording medium is 50 μm or less.

[16] An image forming apparatus described in the embodiment [15], wherein the fixing belt comprises a substrate, and the fixing belt is produced by flattening a convex portion present on a surface of the substrate at a side of the fixing belt contacting with the recording medium, by hot pressing at 150° C. or more and/or abrasion treatment.

[17] An image forming apparatus described in the embodiment [15], wherein the fixing belt comprises a heat-resistant elastic body having a surface contacting with the recording medium, and a substrate disposed at a side opposite to the surface of the heat-resistant elastic body contacting with the recording medium, and the heat-resistant elastic body is formed by forming a coating by applying a resin solution onto an outer periphery of the substrate, which is fixed to an outer periphery of a cylindrical core.

[18] An image forming apparatus described in the embodiment [15], wherein the fixing belt comprises a heat-resistant elastic body having a surface contacting with the recording medium, and a substrate disposed at a side opposite to the surface of the heat-resistant elastic body contacting with the recording medium, and the heat-resistant elastic body comprises a fluorine-based elastomer.

What is claimed is:

1. A fixing method comprising conveying a recording medium on which a toner image has been formed using a fixing belt, in a state in which the fixing belt contacts with a surface of the recording medium on which the toner image is formed, at least from a fixing portion in which the toner image is fixed by heating and pressing the recording medium to a cooling portion in which the recording medium is cooled after fixing, wherein a filtered maximum waviness in every convex portion present on a surface of the fixing belt contacting with the recording medium is 50 μm or less.

2. The fixing method of claim 1, wherein the fixing belt comprises a substrate, and the fixing belt is produced by flattening a convex portion present on the surface of the substrate at a side of the fixing belt contacting with the recording medium, by hot pressing at 150° C. or more and/or abrasion treatment.

3. The fixing method of claim 1, wherein the fixing belt comprises a heat-resistant elastic body having a surface contacting with the recording medium, and a substrate disposed at a side opposite to the surface of the heat-resistant elastic body contacting with the recording medium, and the heat-resistant elastic body is formed by forming a coating by applying a resin solution onto an outer periphery of the substrate, which is fixed to an outer periphery of a cylindrical core.

4. A fixing apparatus comprising a fixing belt that conveys a recording medium on which a toner image has been formed, in a state in which the fixing belt contacts with a surface of the recording medium on which the toner image is formed, at least from a fixing portion in which the toner image is fixed by heating and pressing the recording medium to a cooling portion in which the recording medium is cooled after fixing, wherein a filtered maximum waviness in every convex portion present on a surface of the fixing belt contacting with the recording medium is 50 μm or less.

5. The fixing apparatus of claim 4, wherein the fixing belt comprises a substrate, and the fixing belt is produced by flattening a convex portion present on the surface of the substrate at a side of the fixing belt contacting with the recording medium, by hot pressing at 150° C. or more and/or abrasion treatment.

6. The fixing apparatus of claim 4, wherein the fixing belt comprises a heat-resistant elastic body having a surface contacting with the recording medium, and a substrate disposed at a side opposite to the surface of the heat-resistant elastic body contacting with the recording medium, and the heat-resistant elastic body is formed by forming a coating by applying a resin solution onto an outer periphery of the substrate, which is fixed to an outer periphery of a cylindrical core.

7. The fixing apparatus of claim 4, wherein the fixing belt comprises a heat-resistant elastic body having a surface contacting with the recording medium, and a substrate disposed at a side opposite to the surface of the heat-resistant elastic body contacting with the recording medium, and the heat-resistant elastic body comprises a fluorine-based elastomer.

8. An image forming apparatus comprising at least an image holding member, a charging apparatus that charges a surface of the image holding member, a latent image forming apparatus that forms a latent image on the charged surface of the image holding member, a developing apparatus that develops the latent image with a developer to form a toner image, a transfer apparatus that transfers the toner image to a transfer material, and a fixing apparatus that thermally fixes the toner image on a recording medium, wherein the fixing apparatus comprises a fixing belt that conveys a recording medium on which a toner image has been formed, in a state in which the fixing belt contacts with a surface of the recording medium on which the toner image is formed, at least from a fixing portion in which the toner image is fixed by heating and pressing the recording medium to a cooling portion in which the recording medium is cooled after fixing, wherein a filtered maximum waviness in every convex portion present on a surface of the fixing belt contacting with the recording medium is 50 μm or less.

9. The image forming apparatus of claim 8, wherein the fixing belt comprises a substrate, and the fixing belt is produced by flattening a convex portion present on a surface of the substrate at a side of the fixing belt contacting with the recording medium, by hot pressing at 80° C. or more and/or abrasion treatment.

10. The image forming apparatus of claim 8, wherein the fixing belt comprises a heat-resistant elastic body having a surface contacting with the recording medium, and a substrate disposed at a side opposite to the surface of the heat-resistant elastic body contacting with the recording medium, and the heat-resistant elastic body is formed by forming a coating by applying a resin solution onto an outer periphery of the substrate, which is fixed to an outer periphery of a cylindrical core.

11. The image forming apparatus of claim 8, wherein the fixing belt comprises a heat-resistant elastic body having a surface contacting with the recording medium, and a substrate disposed at a side opposite to the surface of the heat-resistant elastic body contacting with the recording medium, and the heat-resistant elastic body comprises a fluorine-based elastomer.

* * * * *

UNITED STATES PATENT AND TRADEMARK OFFICE

CERTIFICATE OF CORRECTION

PATENT NO. : 7,389,078 B2
APPLICATION NO. : 11/398571
DATED : June 17, 2008
INVENTOR(S) : Fumio Daishi, Noboru Endo and Yasuo Sakaguchi It is certified that error appears in the above-identified patent and that said Letters Patent is hereby corrected as shown below:

On the Title Page should read,
Item (73) Assignee: Fuji Xerox Co., Ltd., Tokyo (JP)

Signed and Sealed this

Second Day of September, 2008

JON W. DUDAS
*Director of the United States Patent and Trademark Office*